US009938608B2

(12) United States Patent
Nielsen, Jr.

(10) Patent No.: US 9,938,608 B2
(45) Date of Patent: Apr. 10, 2018

(54) COMPOSITE ARTICLES COMPRISING SPINODAL COPPER-NICKEL-TIN-MANGANESE-PHOSPHORUS ALLOY MATRIX MATERIAL

(71) Applicant: Materion Corporation, Mayfield Heights, OH (US)

(72) Inventor: William D. Nielsen, Jr., Kingwood, TX (US)

(73) Assignee: MATERION CORPORATION, Mayfield Heights, OH (US)

( * ) Notice: Subject to any disclaimer, the term of this patent is extended or adjusted under 35 U.S.C. 154(b) by 161 days.

(21) Appl. No.: 14/832,838

(22) Filed: Aug. 21, 2015

(65) Prior Publication Data

US 2016/0053349 A1 Feb. 25, 2016

Related U.S. Application Data

(60) Provisional application No. 62/040,287, filed on Aug. 21, 2014.

(51) Int. Cl.

| | |
|---|---|
| ***C22C 29/00*** | (2006.01) |
| ***C22C 9/06*** | (2006.01) |
| ***C22C 9/02*** | (2006.01) |
| ***C22F 1/08*** | (2006.01) |
| ***C22C 1/04*** | (2006.01) |
| ***C22C 1/10*** | (2006.01) |
| ***C22C 26/00*** | (2006.01) |
| ***C22C 29/06*** | (2006.01) |
| *B22F 5/00* | (2006.01) |

(52) U.S. Cl.

CPC ..... *C22C 9/06* (2013.01); *C22C 1/0425* (2013.01); *C22C 1/1036* (2013.01); *C22C 9/02* (2013.01); *C22C 26/00* (2013.01); *C22C 29/005* (2013.01); *C22C 29/067* (2013.01); *C22F 1/08* (2013.01); *B22F 2005/001* (2013.01); *B22F 2998/00* (2013.01)

(58) Field of Classification Search

None

See application file for complete search history.

(56) References Cited

U.S. PATENT DOCUMENTS

| | | | | |
|---|---|---|---|---|
| 3,340,049 | A * | 9/1967 | Quaas | B23K 35/302 106/1.25 |
| 4,681,629 | A * | 7/1987 | Reinshagen | B22F 3/22 419/26 |
| 6,073,518 | A | 6/2000 | Chow et al. | |
| 2012/0067651 | A1 | 3/2012 | Xia et al. | |

FOREIGN PATENT DOCUMENTS

| | | |
|---|---|---|
| DE | 10 2006 019 826 B3 | 8/2007 |
| WO | WO 96/41033 | 12/1996 |

OTHER PUBLICATIONS

International Search Report and Written Opinion dated Dec. 14, 2015 for PCT Application Serial No. PCT/US2015/046381.

* cited by examiner

*Primary Examiner* — Jessee Roe
*Assistant Examiner* — Ngoclan T Mai
(74) *Attorney, Agent, or Firm* — Richard M. Klein; Fay Sharpe LLP

(57) ABSTRACT

A spinodal copper-nickel-tin-manganese alloy is disclosed that contains from 0.001 to about 2 weight percent phosphorus. When combined with small hard particles, the alloy has sufficient fluidity to infiltrate and fill at least 90% of the interstices of the hard particles, resulting in a composite article having superior strength and toughness. This composite article can be used in drilling bits and other cutting tools, either as a support body for cutting elements or as the cutting element itself.

15 Claims, 1 Drawing Sheet

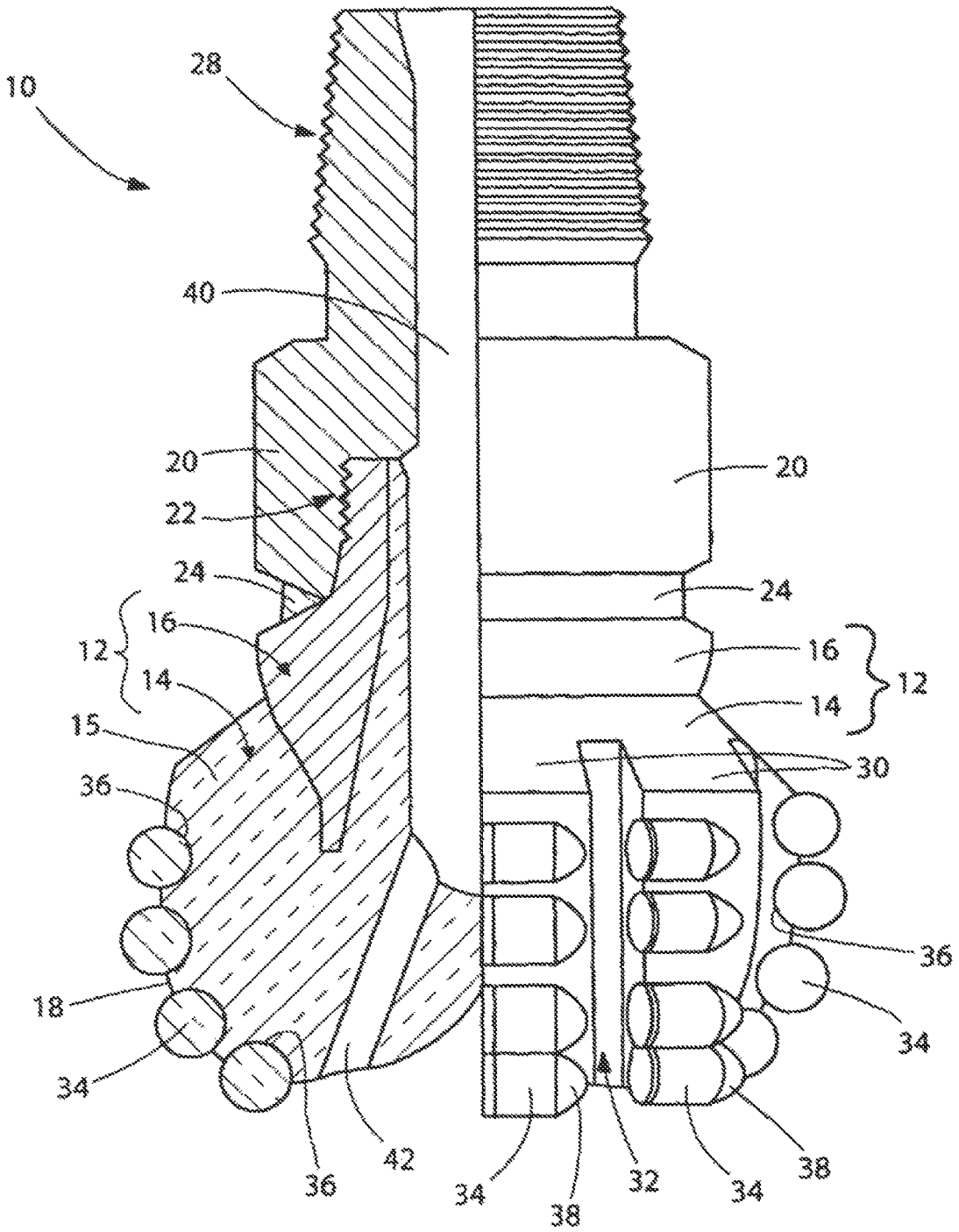
10
28
40
20
22
24
12
16
14
15
36
18
34
36
42
34
38
32
34
38
20
24
16
12
14
30
36
34

COMPOSITE ARTICLES COMPRISING SPINODAL COPPER-NICKEL-TIN-MANGANESE-PHOSPHORUS ALLOY MATRIX MATERIAL

CROSS-REFERENCE TO RELATED APPLICATIONS

This application claims priority to U.S. Provisional Patent Application Ser. No. 62/040,287, filed Aug. 21, 2014, the entirety of which are fully incorporated by reference.

BACKGROUND

The present disclosure relates to spinodal copper-nickel-tin-manganese-phosphorus alloys. The alloys may be particularly useful as a matrix material in a composite article with superior strength and toughness. Such composite articles may be used, for example, as drill bits or cutting tools for boring through rock and other material.

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earth formation and proceeds to form a borehole along a predetermined path toward a target zone.

The body of a drill bit can be formed from a particle-matrix composite material. Such composite materials generally include hard particles (e.g. fragments of diamond, tungsten carbide, etc.) dispersed in a copper-based alloy matrix. Such bit bodies can be formed by embedding the hard particles within a mold, and infiltrating the particles with molten copper-based alloy. Drill bits having bit bodies formed from such composite materials may exhibit increased erosion and wear resistance, but lower strength and toughness, relative to drill bits having steel bit bodies.

However, conventional copper-nickel-tin alloys are insufficiently fluid (i.e., too viscous) to act as a matrix material and fill all of the interstices between the hard particles in conventional fabrication processes. This reduces the strength and toughness of the resulting composite material. It would be desirable to provide composite materials for use in drill bit bodies that exhibit enhanced physical properties.

BRIEF DESCRIPTION

The present disclosure relates to spinodal copper-nickel-tin-manganese-phosphorus alloys and their use as a matrix phase in composite articles (e.g., drill bits). These alloys are sufficiently fluid to fill at least 90% of the interstices of small hard particles when forming the matrix phase. The composite article can then be used as a drill bit or other cutting tool.

Disclosed in various embodiments are composite articles comprising: a matrix phase comprising a spinodal alloy; and hard particles dispersed within the matrix phase. In specific embodiments, the spinodal alloy is a Cu—Ni—Sn—Mn—P alloy comprising: from about 5 wt % to about 22 wt % nickel; from about 4 wt % to about 10 wt % tin; from about 0.05 wt % to about 0.5 wt % manganese; from 0.001 to about 2 wt % phosphorus; and balance copper. The hard particles used in the composite article may be selected from diamond, a ceramic, a carbide, a boride, or a nitride, in a random or set orientation within the composite article.

The composite article may be a drill bit. The article may be used to hold/set other cutting elements, such as diamond inserts or other small hard materials. Alternatively, the composite article can be used to form the cutting element itself, as described further herein.

The spinodal alloy may comprise from about 0.1 wt % to about 1 wt % phosphorus, or from about 0.25 wt % to about 0.75 wt % phosphorus. The spinodal alloy may comprise from about 14.5 wt % to about 15.5 wt % nickel; and from about 7.5 wt % to about 8.5 wt % tin.

In further particular embodiments, the spinodal alloy comprises from about 14.5 wt % to about 15.5 wt % nickel; from about 7.5 wt % to about 8.5 wt % tin; from about 0.05 wt % to about 0.15 wt % manganese; from about 0.25 wt % to about 0.75 wt % phosphorus; and balance copper.

The composite article may be heat treated to affect spinodal decomposition of the spinodal alloy.

In various embodiments, the spinodal alloy has a 0.2% offset yield strength of 80 ksi or higher, or a Rockwell C hardness of at least 25.

The composite article may comprise from about 20 wt % to about 40 wt % of the matrix phase and from about 60 wt % to about 80 wt % of the hard particles.

Also disclosed herein are spinodal alloys comprising: from about 5 wt % to about 22 wt % nickel; from about 4 wt % to about 10 wt % tin; from about 0.05 wt % to about 0.5 wt % manganese; from 0.001 to about 2 wt % phosphorus; and balance copper.

Also disclosed are methods of forming a composite article comprising: infiltrating a body of small hard particles with a liquefied spinodal alloy to form a matrix phase; and solidifying the matrix phase to form the composite article; wherein the spinodal alloy is a Cu—Ni—Sn—Mn—P alloy comprising: from about 5 wt % to about 22 wt % nickel; from about 4 wt % to about 10 wt % tin; from about 0.05 wt % to about 0.5 wt % manganese; from 0.001 to about 2 wt % phosphorus; and balance copper.

The method can further comprise heat treating the article at a temperature of from about 600° F. to about 800° F., and for a time period of from about 2 hours to about 4 hours. This results in spinodal decomposition of the alloy.

In particular embodiments, metal shot of the spinodal alloy is combined with the body of hard particles to form a mixture, and the mixture is heated to liquefy the metal shot, permitting infiltration of the body of hard particles.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

FIG. 1 is a partial cross-sectional side view of a drill bit that comprises the composite materials of the present disclosure.

DETAILED DESCRIPTION

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4."

Percentages of elements should be assumed to be percent by weight of the stated alloy, unless expressly stated otherwise.

As used herein, the term "spinodal alloy" refers to an alloy whose chemical composition is such that it is capable of undergoing spinodal decomposition. The term "spinodal alloy" refers to alloy chemistry, not physical state. Therefore, a "spinodal alloy" may or may not have undergone spinodal decomposition and may or not be in the process of undergoing spinodal decomposition.

Spinodal aging/decomposition is a mechanism by which multiple components can separate into distinct regions or microstructures with different chemical compositions and physical properties. In particular, crystals with bulk composition in the central region of a phase diagram undergo exsolution. Spinodal decomposition at the surfaces of the alloys of the present disclosure results in surface hardening.

Spinodal alloy structures are made of homogeneous two phase mixtures that are produced when the original phases are separated under certain temperatures and compositions referred to as a miscibility gap that is reached at an elevated temperature. The alloy phases spontaneously decompose into other phases in which a crystal structure remains the same but the atoms within the structure are modified but remain similar in size. Spinodal hardening increases the yield strength of the base metal and includes a high degree of uniformity of composition and microstructure.

The present disclosure relates to spinodal copper-nickel-tin-manganese-phosphorus alloys, composite articles containing the alloys, and methods for making the composite articles. In particular, such alloys are useful for making drill bits.

The spinodal copper-nickel-tin (CuNiSn) alloys disclosed herein comprise from about 5 wt % to about 22 wt % nickel, and from about 4 wt % to about 10 wt % tin. In more specific embodiments, the spinodal alloys comprise from about 14.5 wt % to about 15.5 wt % nickel, and from about 7.5 wt % to about 8.5 wt % tin.

The spinodal alloys also contain phosphorus. Without being bound by theory, it is believed that the addition of phosphorus improves the fluid properties of the alloy when the alloy is in a molten state. This permits the molten alloy to flow better and thus fill interstices better. In more particular embodiments, the spinodal alloys include from 0.001 wt % to about 2 wt %, or from about 0.1 wt % to about 1 wt %, or from about 0.25 wt % to about 0.75 wt % phosphorus.

The spinodal alloys also contain manganese. Without being bound by theory, it is believed that the inclusion of manganese improves the ductility and toughness of the alloy. In more particular embodiments, the spinodal alloys include from 0.05 wt % to about 0.5 wt %, or from about 0.05 wt % to about 0.15 wt % manganese.

The spinodal copper-nickel-tin-manganese-phosphorus alloys disclosed herein thus comprise from about 5 wt % to about 22 wt % nickel, from about 4 wt % to about 10 wt % tin, from about 0.05 wt % to about 0.5 wt % manganese, from about 0.001 wt % to about 2 wt % phosphorus, and balance copper. More preferably, the copper-nickel-tin alloys comprise about 14.5 wt % to about 15.5 wt % nickel, from about 7.5 wt % to about 8.5 wt % tin, from about 0.05 wt % to about 0.15 wt % manganese, from about 0.25 wt % to about 0.75 wt % phosphorus, and balance copper.

The spinodal alloys may further include impurities such as beryllium, cobalt, iron, silicon, aluminum, zinc, chromium, lead, magnesium, zirconium, niobium, or titanium. For purposes of this disclosure, amounts of less than 0.01 wt % of these elements should be considered to be unavoidable impurities, i.e. their presence is not intended or desired. It is noted that phosphorus is desired in smaller quantities.

Composite articles can be made from the copper-nickel-tin-manganese-phosphorus spinodal alloy. More specifically, in such composite articles, the spinodal alloy is a matrix phase material that is combined with hard particles as a dispersed phase within the matrix phase. The term "hard" refers to materials having a Vickers hardness (HV) of at least 1000 when tested separately from the spinodal alloy.

The hard particles can be diamond, ceramics, carbides, borides, or nitrides. It is noted that these groups overlap (e.g. many carbides are also ceramics). Exemplary carbides include tungsten carbide, tantalum carbide, niobium carbide, molybdenum carbide, chromium carbide, vanadium carbide, zirconium carbide, hafnium carbide, titanium carbide, and silicon carbide. Exemplary borides include titanium diboride. Exemplary nitrides include boron nitride. These hard particles can be considered small fragments that have cutting edges.

The hard particles generally have an average particle size (diameter) from about 100 micrometers (μm) to about 2,000 μm (or 2 mm), or from about 500 μm to about 1000 μm.

The relative amounts of the spinodal alloy and the hard particles can be selected to produce the desired ratio of matrix phase and dispersed phase in the final composite material. The hard particles usually are the majority of the composite material on a weight percentage basis. The composite articles may include from about 20 to about 40 wt % of the spinodal alloy, and from about 60 wt % to about 80 wt % of the hard particles.

The composite material is typically made by an infiltration process in which a mixture of the hard particles and relatively small metal pieces (e.g. shot, chopped wire, chopped rod) of the spinodal alloy is formed, then heated to melt the spinodal alloy. The molten spinodal alloy has sufficient fluidity (i.e., low enough viscosity) to effectively infiltrate and fill voids/interstices between the hard particles before solidifying to form a matrix phase carrying the hard particles as a disperse phase. In some embodiments, at least 90% of the interstices within the body of hard particles are filled.

The hard particles can be homogeneously or heterogeneously dispersed within the spinodal alloy matrix, for example by using a mold. This permits the hard particles to be located in desired locations in the composite material. The orientation of the hard particles can be random or set (i.e. non-random).

Upon solidification of the spinodal alloy, the resulting composite of spinodal alloy and hard particles may be heat treated to cause spinodal decomposition of the alloy component, thereby providing a composite having superior strength and toughness compared to current art materials. Alternatively, the composite can be used without heat treatment, resulting in a composite having similar strength but greater toughness than conventional materials.

Heat treatment is a controlled process of heating and cooling the composite to alter the physical and mechanical properties of the metal matrix phase without changing the product shape. Heat treatment is associated with increasing the strength of the material but it can also be used to alter certain manufacturability objectives such as to improve machining, improve formability, or to restore ductility after a cold working operation. Heat treatment can be performed by exposing the composite in a furnace or similar apparatus to an elevated temperature in the range of about 600° F. to about 800° F. for a time period of from about 2 hours to about 4 hours. It is noted that these temperatures refer to the temperature of the atmosphere to which the composite is exposed, or to which the furnace is set; the composite itself does not necessarily reach these temperatures. The resulting composite articles can be harder and stronger than conventional materials and capable of withstanding higher shear stresses. These properties lead to extended lifetimes and more effective operation.

After heat treatment, the spinodal alloy may have a 0.2% offset yield strength of 80 ksi or higher, including a range of 80 ksi to about 125 ksi. The spinodal alloy may have an ultimate tensile strength of about 100 ksi to about 140 ksi. The spinodal alloy may have a Rockwell C hardness of at least 25. These values are measured for the alloy alone.

The resulting composite article can be used in many different applications in the oil and gas industry, such as drill bits, cutting tools, and the like. The composite article can be used to form the body of the drill bit that supports cutting elements, or can be used to make the cutting element itself.

FIG. 1 is a cross-sectional illustration of an earth-boring rotary drill bit 10 that can be formed from the composite material described herein. The drill bit 10 includes a body 12 that can comprise the composite material formed from the hard particles and the spinodal alloy. As illustrated here, the body 12 includes a crown region 14 and a transition region 16. The crown region 14 is a composite article that can be formed from the composite material 15 of spinodal alloy and hard particles. The transition region 16 is used to secure the crown region 14 of the body 12 to a metal shank 20 that is configured for securing the drill bit 10 to a drill string. The transition region 16 can also be made from the composite material, or may be made separately from a metal or metal alloy. The body 12 can be secured to the shank 20, for example, by a threaded connection 22 and a weld 24 that extends around the drill bit 10 on an exterior surface thereof along an interface between the body 12 and the metal shank 20. The metal shank 20 may be formed from steel, and may include an American Petroleum Institute (API) threaded end 28 for attaching the drill bit 10 to a drill string (not shown). Alternatively, the body 12 could be secured to the shank by drilling holes through the body 12 and using pins to join the body 12 to the shank 20 (not shown).

The body 12 can include wings or blades 30 that are separated from one another by junk slots 32. Internal fluid passageways 42 extend between the face 18 of the body 12 and a longitudinal bore 40, which extends through the steel shank 20 and at least partially through the body 12. In some embodiments, nozzle inserts (not shown) can be provided at the face 18 of the body 12 within the internal fluid passageways 42.

A plurality of cutting elements 34 is present on the face 18 of the body 12. For example, as illustrated here, a plurality of polycrystalline diamond compact (PDC) cutters 34 are provided on each of the blades 30, as shown in FIG. 1. The PDC cutters 34 may be provided along the blades 30 within pockets 36 formed in the face 18 of the body 12, and may be supported from behind by buttresses 38, which may be integrally formed with the crown region 14 of the body 12. Alternatively, the cutting elements 34 can be formed from the composite material.

The rotary drill bit 10 is fabricated by separately forming the body 12 and the shank 20, and then attaching the shank 20 and the body 12 together. The body 12 may be formed by, for example, providing a mold (not shown) having a mold cavity having a size and shape corresponding to the size and shape of the body 12. Preform elements or displacements can be positioned within the mold cavity to define the internal passageways 42, cutting element pockets 36, junk slots 32, and other external topographic features of the body 12.

The cutting elements 34 may be bonded to the face 18 of the body 12 after the body 12 has been cast by, for example, brazing, mechanical affixation, or adhesive affixation. In other methods, the PDC cutters 34 may be provided within the mold and bonded to the face 18 of the body 12 during infiltration or furnacing of the body 12 if thermally stable synthetic diamonds, or natural diamonds, are employed.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A composite article comprising:

a matrix phase comprising a spinodal alloy; and hard particles dispersed within the matrix phase;

wherein the spinodal alloy is a Cu—Ni—Sn—Mn—P alloy comprising:

from about 5 wt % to about 22 wt % nickel;

from about 4 wt % to about 10 wt % tin;

from about 0.05 wt % to about 0.5 wt % manganese; from about 1 wt % to about 2 wt % phosphorus; and balance copper.

2. The composite article of claim 1, wherein the composite article is a body of a drill bit or a cutting element.

3. The composite article of claim 1, wherein the spinodal alloy comprises from about 14.5 wt % to about 15.5 wt % nickel; and from about 7.5 wt % to about 8.5 wt % tin.

4. The composite article of claim 1, wherein the spinodal alloy comprises from about 14.5 wt % to about 15.5 wt % nickel; from about 7.5 wt % to about 8.5 wt % tin; from about 0.05 wt % to about 0.15 wt % manganese; from about 1 wt % to about 2 wt % phosphorus; and balance copper.

5. The composite article of claim 1, wherein the composite article is heat treated to affect spinodal decomposition of the spinodal alloy.

6. The composite article of claim 1, wherein the spinodal alloy has a 0.2 % offset yield strength of 80 ksi or higher, or a Rockwell C hardness of at least 25.

7. The composite article of claim 1, wherein the composite article comprises from about 20 wt % to about 40 wt % of the matrix phase and from about 60 wt % to about 80 wt % of the hard particles.

8. The composite article of claim 1, wherein the hard particles are diamond, a ceramic, a carbide, a boride, or a nitride.

9. A spinodal alloy for forming the matrix phase of a cutting tool, comprising:

from about 5 wt % to about 22 wt % nickel;
from about 4 wt % to about 10 wt % tin;
from about 0.05 wt % to about 0.5 wt % manganese;
from about 1 wt % to about 2 wt % phosphorus; and balance copper.

10. The spinodal alloy of claim 9, wherein the spinodal alloy comprises from about 14.5 wt % to about 15.5 wt % nickel; and from about 7.5 wt % to about 8.5 wt % tin.

11. The spinodal alloy of claim 9, wherein the spinodal alloy comprises from about 14.5 wt % to about 15.5 wt % nickel; from about 7.5 wt % to about 8.5 wt % tin; from about 0.05 wt % to about 0.15 wt % manganese; from about 1 wt % to about 2 wt % phosphorus; and balance copper.

12. The spinodal alloy of claim 9, wherein the spinodal alloy has a 0.2% offset yield strength of 80 ksi or higher, or a Rockwell C hardness of at least 25.

13. The composite article of claim 1, wherein the hard particles include interstices, and wherein the spinodal alloy has sufficiently low fluidity to fill at least 90% of the interstices of the hard particles.

14. The composite article of claim 1, wherein the spinodal alloy comprises from about 0.4 wt % to about 0.5 wt % manganese.

15. The composite article of claim 9, wherein the spinodal alloy comprises from about 0.4 wt % to about 0.5 wt % manganese.

* * * * *